US005935688A

United States Patent [19]

Bergthaller et al.

[11] Patent Number: 5,935,688

[45] Date of Patent: Aug. 10, 1999

[54] INKJET RECORDING MATERIAL

[75] Inventors: Peter Bergthaller, Bergisch Gladbach; Stefan Herrmann, Bonn, both of Germany

[73] Assignee: Agfa-Gevaert AG, Germany

[21] Appl. No.: 08/841,072

[22] Filed: Apr. 29, 1997

[30] Foreign Application Priority Data

May 6, 1996 [DE] Germany ..... 196 18 088

[51] Int. Cl.[6] ..... B41M 5/00

[52] U.S. Cl. ..... 428/195; 347/105; 428/211; 428/478.2; 428/478.8; 428/513; 428/704

[58] Field of Search ..... 347/105; 428/195, 428/411.1, 478.2, 478.4, 478.8, 704, 211, 513

[56] References Cited

U.S. PATENT DOCUMENTS 5,073,448 12/1991 Vieira et al. ..... 428/331
5,500,668 3/1996 Malhotra et al. ..... 347/105

*Primary Examiner*—Bruce H. Hess
*Attorney, Agent, or Firm*—Connolly & Hutz

[57] ABSTRACT

The light-fastness of an inkjet recording material having a support and an image-receiving layer containing a binder is improved if the image-receiving layer contains a water soluble inorganic thiosulphate, trithionate or tetrathionate or an organic thiosulphate in a quantity of 2 to 200 wt. %, relative to the quantity of binder in the image-receiving layer.

10 Claims, No Drawings

INKJET RECORDING MATERIAL

This invention relates to a recording material for inkjet images which are obtained by spraying a dye solution or suspension in a fine, imagewise modulated jet. The recording material consists of a transparent, semi-transparent or opaque support and an image-receiving layer located thereon.

The inkjet process is known (c.f. for example the chapter *Ink Jet Printing* by R. W. Kenyon in *Chemistry and Technology of Printing and Imaging Systems,* editor Peter Gregory, Blackie Academic & Professional, Chapman & Hall 1996, pages 113 to 138 and the literature cited therein).

It is known that the light-fastness of images produced using the inkjet process is not sufficient and cannot compete, for example, with the light-fastness of colour photographic images produced on colour paper using the conventional chromogenic process. An object of the invention is to overcome this shortcoming in light-fastness and to bring the light-fastness of inkjet images into line with the light-fastness of colour photographs.

The light-fastness of inkjet prints is far from being equally poor for all the individual colours, but is instead highly dependent upon the nature of dye used. Thus, for example, yellow colours based on pyrazolone-based azo dyes are still moderately light-fast, while rhodamine-based magenta dyes are only inadequately light-fast and triphenylmethane-based cyan dyes also have only very poor light-fastness. Magenta-coloured azo dyes of the acyl-H acid derivative class assume an intermediate position.

One object of the invention is as comprehensively as possible to improve the light-fastness of as many as possible of the stated classes of dyes.

It has surprisingly been found that this may be achieved in a simple manner if a recording material for the inkjet process contains an image-receiving layer containing a binder, which layer, relative to the binder, contains 2 to 200 wt. % of a water-soluble inorganic thiosulphate, trithionate or tetrathionate or an organic thiosulphate.

Preferred thiosulphates are alkali metal thiosulphates or those ammonium thiosulphates which eliminate no volatile amines on contact with alkaline inks. They may also be salts of high molecular weight ammonium ions, for example of polymeric diallylammonium salts. The tetrathionate ion may also be attached to high molecular weight ammonium ions.

So-called Bunte salts are used as the organic thiosulphates, preferably those which liberate no volatile thiols or disulphides when hydrolysed by acid or alkali. Particularly favourable Bunte salts are, for example, obtainable from chloroacetic acid salts, from chloroacetamide or from analogous α-chloroalkanoic acid derivatives and they may also be produced in the appropriate layer by reacting an appropriate alkylating agent with an alkali metal thiosulphate. The synthesis of Bunte salts is described, for example in H. Distler, *Angew. Chem.* 79 page 520 (1967).

The Bunte salts may also be present in the form of an internal salt which contains a primary, secondary, tertiary or quaternary ammonium function as a counterion for the thiosulphate group. The thiosulphate or Bunte salts may also be present attached to a particulate cation exchanging polymer with tertiary or quaternary ammonium groups.

Preferred organic thiosulphates are of the general formula I (I)

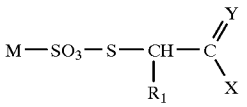

in which

M means an alkali metal or ammonium ion $R_1$ means H, alkyl or aryl

Y means O or N-Z,

X means OH, OMe or an amide group unsubstituted, mono- or disubstituted on the nitrogen or, together with Z, means the remaining members of a 5- to 7-membered heterocycle and Z together with X means the remaining members of a 5- to 7-membered heterocycle.

Organic thiosulphates (Bunte salts) according to the invention:

1.

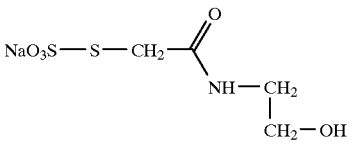

2.

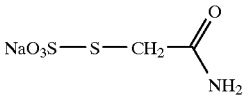

3.

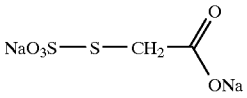

-continued
4.
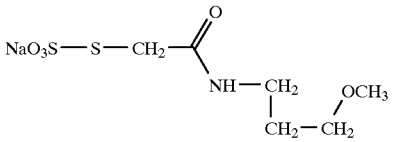
5.
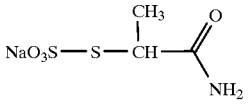
6.
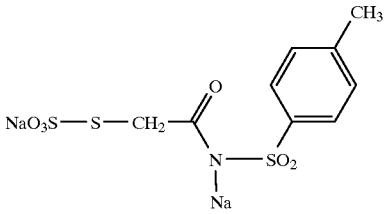
7.
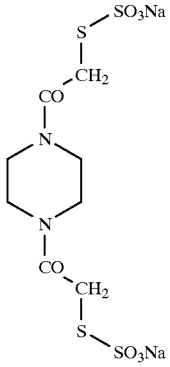
8.
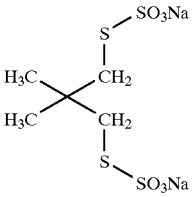
9.
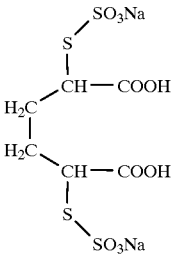
10.
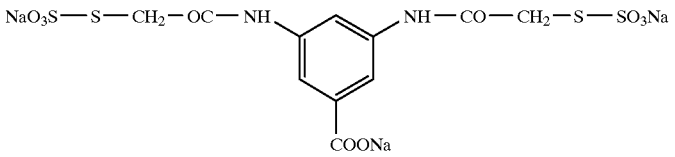

-continued
11.
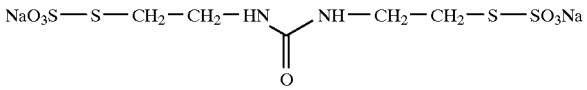
12.
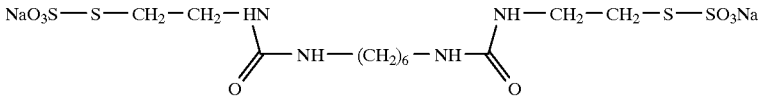
13.
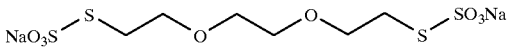
14.
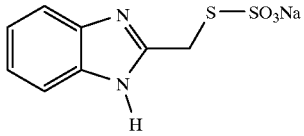
15.
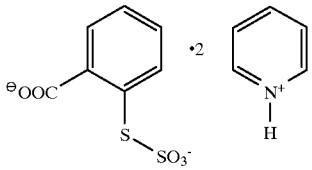
16.
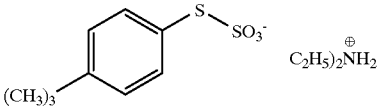
17.
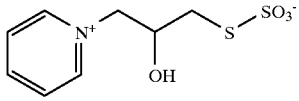
18.
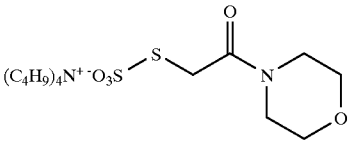
19.
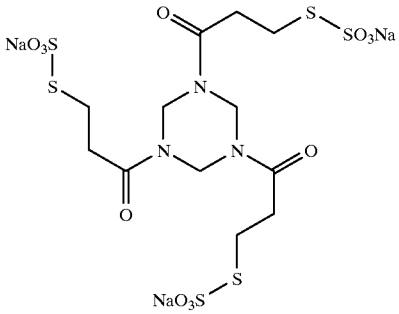
20.
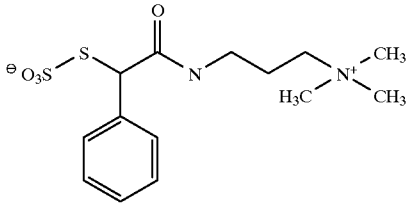

-continued

21.

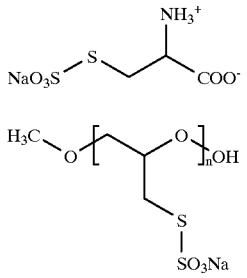

22.

Incorporation of the thiosulphates generally has no negative effect on the colour bonding capacity of the image-receiving layer and the quantity of thiosulphate may readily be adjusted such that neither does the salt crystallise nor is surface gloss reduced.

The layer receiving the ink image preferably consists of a protein, for example of gelatine, of casein, albumin, of a cellulose or polyvinyl alcohol derivative or of an acrylamide copolymer which contains both acidic and basic groups. Hydrophilic silica gels also yield very favourable image-receiving layers. It is also possible to improve the handle of the material by incorporating silica gel particles.

The light-fastness of the inkjet prints is preferably improved if the image-receiving layer contains a non-volatile alkylated phenol in the form of a finely divided dispersion.

Non-volatile, alkylated phenols which may be considered are in particular di- or trialkylphenols, the alkyl groups of which together contain at least 4 C atoms, for example 2,4-di-tert.-butylphenol or 2,4-di-tert.-amylphenol.

EXAMPLE 1

A paper coated on both sides with polyethylene and of a weight of 90 g/m$^2$ is provided with a 10 $\mu$m thick layer of gelatine with the addition of the fluorinated surfactant of the formula $C_8F_7SO_3^{\ominus}(C_2H_5)_4N^{\oplus}$ (0.1 wt. % relative to gelatine). The gelatine contains 20 g of sodium thiosulphate per 100 g and is hardened with 1 g of the instant hardener of the formula

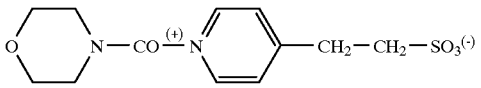

EXAMPLE 2

The same method is used as in Example 1, but with the difference that, instead of sodium thiosulphate, the Bunte salt 1 obtained from chloroacetamide and sodium thiosulphate is used in a quantity of 35 g/100 g of gelatine.

EXAMPLE 3

The same method is used as in Example 1, but with the difference that the layer contains the Bunte salt 2 prepared from N-chloroacetylethanolamine and sodium thiosulphate in a quantity of 35 g/100 g of gelatine.

EXAMPLE 4

The same method is used as in Example 1, but with the difference that, instead of thiosulphate, the Bunte salt 17 is used in a quantity of 35 g/100 g of gelatine.

EXAMPLE 5

The same method is used as in Example 1, but with the difference that, instead of thiosulphate, the Bunte salt 18 is used in a quantity of 35 g/100 g of gelatine.

EXAMPLE 6

The same method is used as in Example 1, but with the difference that, instead of thiosulphate, the Bunte salt 21 is used in a quantity of 35 g/100 g of gelatine.

EXAMPLE 7

The same method is used as in Example 1, but with the difference that 39 g of di-tert.-amylphenol per 100 g of gelatine are additionally added as an emulsion.

EXAMPLE 8

The same method is used as in Example 7, but without adding sodium thiosulphate.

EXAMPLE 9

The same method is used as in Example 1, but without adding the hardener. The resultant layer is overcoated with a second gelatine layer at a gelatine application rate of 1 g/m$^2$, wherein the gelatine contains 150 g of pyrogenic silica as a flatting agent and 10 g of the instant hardener stated in Example 1 per 100 g of gelatine.

EXAMPLE 10 (COMPARISON)

The same method is used as in Example 1, but with the difference that sodium thiosulphate is not added.

One dried specimen of each paper is sprayed with a full density pattern of colour fields containing the primary colours yellow (gb), magenta (pp), cyan (bg), blue (b), green (g) and red (r).

The inks contain the following dyes:

yellow: dye A (Acid Yellow 23), magenta: 1:1 mixture of dyes B and C cyan: 1:1 mixture of dyes D (Direct Blue 86) and E Dye A

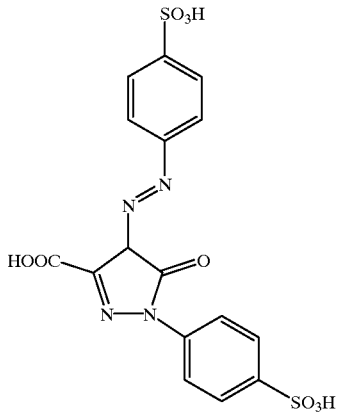

Dye B

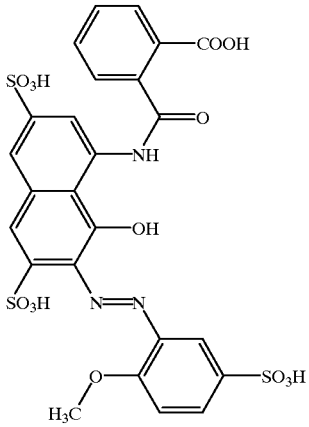

Dye C

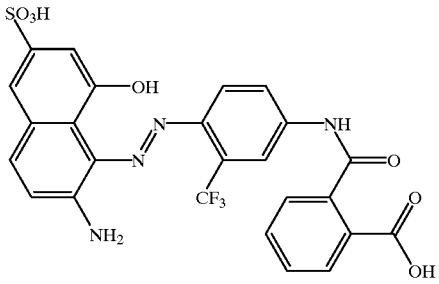

Dye D

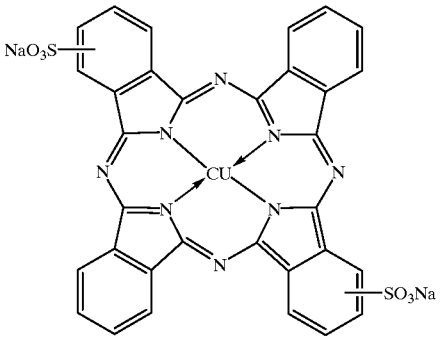

-continued

Dye E

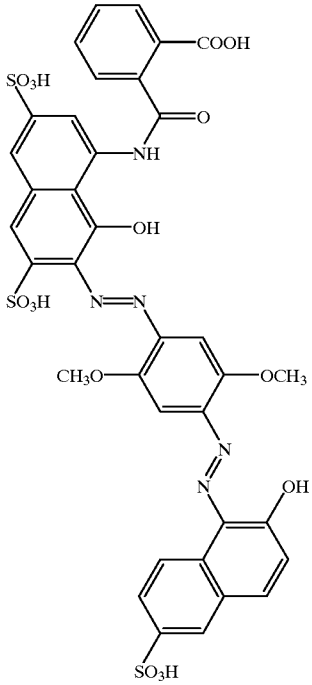

The printed sheets are cut in half and one half exposed to sunlight at an east-facing window for three weeks and then compared with the corresponding unexposed sheets. The comparison is made by measuring reflected density at five points on each colour and calculating a mean value.

Test results:

Key:

rF=red filter; bF=blue filter; gF=green filter; I=according to the invention; C=comparison.

| | | Percentage loss of density in colour field measured behind appropriate additive colour filter | | | | | | | | |
|---|---|---|---|---|---|---|---|---|---|---|
| | | gb | pp | bg | b | | g | | r | |
| Example | | bF | gF | rF | gF | rF | bF | rF | bF | gF |
| 1 | I | 20 | 30 | 20 | 32 | 35 | 25 | 35 | 30 | 30 |
| 2 | I | 15 | 30 | 25 | 28 | 30 | 32 | 33 | 24 | 37 |
| 3 | I | 28 | 40 | 20 | 32 | 25 | 28 | 40 | 40 | 40 |
| 4 | I | 25 | 35 | 38 | 30 | 35 | 25 | 38 | 30 | 45 |
| 5 | I | 25 | 40 | 38 | 32 | 32 | 20 | 38 | 28 | 38 |
| 6 | I | 30 | 38 | 40 | 35 | 40 | 35 | 39 | 31 | 37 |
| 7 | I | 20 | 25 | 25 | 25 | 25 | 25 | 30 | 25 | 28 |
| 8 | C | 45 | 60 | 60 | 60 | 60 | 40 | 50 | 30 | 50 |
| 9 | I | 30 | 30 | 32 | 30 | 35 | 20 | 30 | 20 | 35 |
| 10 | C | 60 | 65 | 60 | 70 | 65 | 50 | 75 | 40 | 75 |

We claim:

1. An inkjet recording material which comprises a support and an image-receiving layer containing a binder, said image-receiving layer contains a water soluble trithionate or tetrathionate or an organic thiosulphate in a quantity of 2 to 200 wt. %, relative to the quantity of binder in the image-receiving layer.

2. The inlet recording material according to claim 1, wherein said image-receiving layer contains an organic thiosulphate of the formula

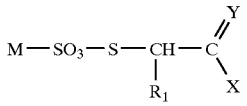

in which

M means an alkali metal or ammonium ion $R_1$ means H, alkyl or aryl

Y means O or N-Z,

X means OH, OMe or an amide group unsubstituted, mono or disubstituted on the nitrogen or, together with Z, means the remaining members of a 5- to 7-membered heterocycle and Z together with X means the remaining members of a 5- to 7-memebered heterocycle.

3. The inkjet recording material according to claim 2, wherein said organo thiosulphate is selected from the group consisting of

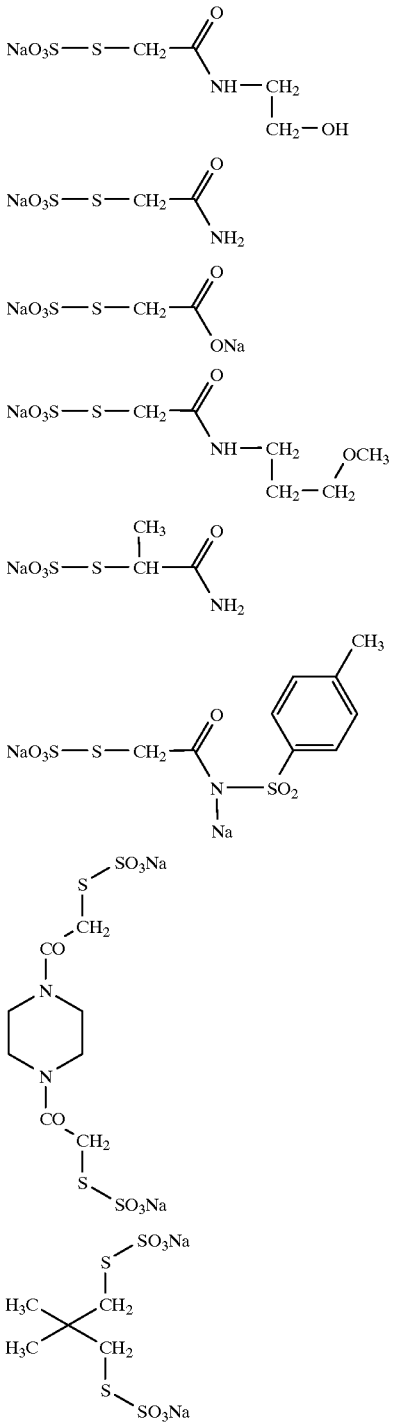

-continued
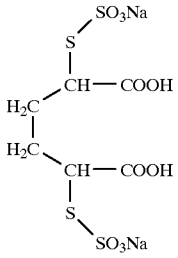
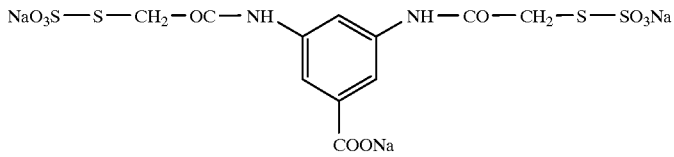
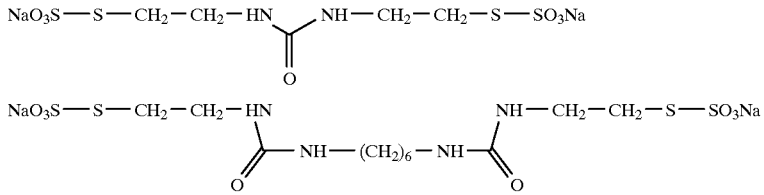
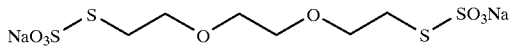
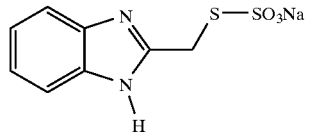
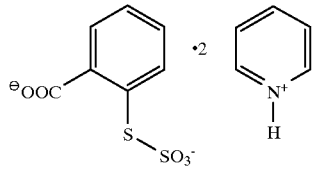
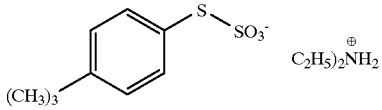
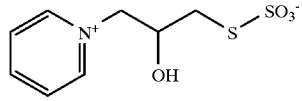
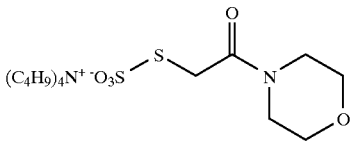
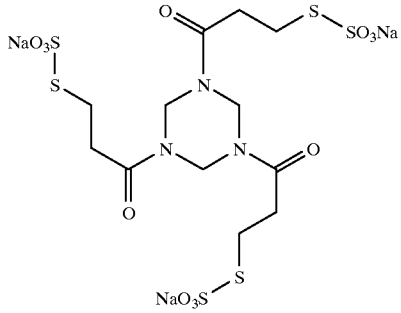

-continued

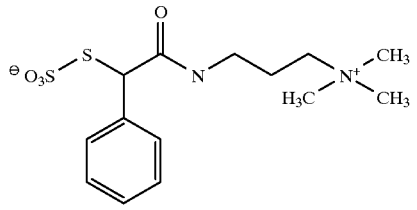

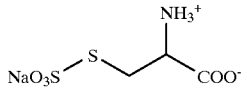

and

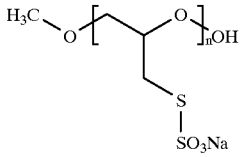

wherein n is from 3 to 10.

4. The inkjet recording material according to claim 1, wherein the binder of the image-receiving layer is hardened gelatine.

5. The inkjet recording material according to claim 1, wherein the image-receiving layer contains a non-volatile alkylated phenol in the form of a finely divided dispersion.

6. The inkjet recording material according to claim 5, wherein said non-volatile alkylated phenol is dialkyl phenol or trialkyl phenol wherein said alkyl group contains at least four carbon atoms.

7. The recording material of claim 1, employing trithionate, organic thiosulphate or tetrathionate having an image thereon.

8. The recording material according to claim 7 employing trithionate or tetrathionate having an image thereon.

9. A process of imaging the recording material of claim 1, which comprises spraying a pattern on the image receiving layer which contains trithionate, tetrathionate or an organic thiosulphate and then exposing said pattern.

10. The process as claimed in claim 9 wherein the image receiving layer contains trithionate or tetrathionate.

* * * * *